US007942209B1

(12) United States Patent
Volz et al.

(10) Patent No.: US 7,942,209 B1
(45) Date of Patent: May 17, 2011

(54) DUAL BLADE UNIT

(76) Inventors: Gary Volz, Amana, IA (US); Shane Volz, Coralville, IA (US)

( * ) Notice: Subject to any disclaimer, the term of this patent is extended or adjusted under 35 U.S.C. 154(b) by 0 days.

(21) Appl. No.: 12/484,570

(22) Filed: Jun. 15, 2009

Related U.S. Application Data

(60) Provisional application No. 61/131,898, filed on Jun. 13, 2008.

(51) Int. Cl.
*A01B 49/00* (2006.01)

(52) U.S. Cl. ..... 172/197

(58) Field of Classification Search ..... 172/197, 172/445.1, 445.2, 199, 684.5, 685, 799.5, 172/815–820, 792, 795, 796; 37/231, 235, 37/266–268, 281, 444, 445
See application file for complete search history.

(56) References Cited

U.S. PATENT DOCUMENTS 2,899,760 A * 8/1959 Armington et al. ..... 172/777
3,430,703 A * 3/1969 Richey ..... 172/136
3,470,964 A * 10/1969 Collins et al. ..... 172/197
3,834,465 A 9/1974 Collins
4,320,988 A 3/1982 Seal
4,821,810 A * 4/1989 Buchanan ..... 172/197
4,869,326 A * 9/1989 Hutchins et al. ..... 172/197
5,024,280 A * 6/1991 Mork ..... 172/197
7,584,805 B2 * 9/2009 Skaggs ..... 172/684.5
7,661,210 B2 * 2/2010 Shepherd ..... 37/232

* cited by examiner

*Primary Examiner* — Robert E Pezzuto
(74) *Attorney, Agent, or Firm* — Hamilton IP Law, PC.; Jay R. Hamilton; Charles A. Damschen

(57) ABSTRACT

An apparatus for earth working or material moving includes a first and a second blade oriented substantially parallel to one another. The two blades each have non-working blade faces positioned adjacent one another and working blade faces opposite one another. The two blades are moveable with respect to one another in the vertical direction, but fixed to one another in the horizontal direction. In this way, the working face of a first blade may be used in a first direction, and the working face of a second blade may be used in a second direction. The dual blade unit may be pivotally connected to an extending arm so that the angle of the first and second blades with respect to the direction of travel may be adjusted to the specifications of the user.

15 Claims, 8 Drawing Sheets

DUAL BLADE UNIT

CROSS REFERENCE TO RELATED APPLICATIONS

This application claims the filing benefit under 35 U.S.C. §119(e) of provisional U.S. Patent Application Ser. No. 61/131,898 filed on Jun. 13, 2008, which is incorporated by reference herein in its entirety.

FIELD OF THE INVENTION

The apparatus described herein is generally applicable to the field of earth working. The embodiments shown and described herein are more particularly for an improved scraper blade.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. §1.71(d)

A portion of the disclosure of this patent document contains material which is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

DETAILED DESCRIPTION

Brief Description of Drawings

In order that the advantages of the dual blade unit will be readily understood, a more particular description of the dual blade unit briefly described above will be rendered by reference to specific embodiments illustrated in the appended drawings. Understanding that these drawings depict only typical embodiments of the dual blade unit and are not therefore to be considered limited of its scope, the dual blade unit will be described and explained with additional specificity and detail through the use of the accompanying drawings.

DETAILED DESCRIPTION

Listing of Elements

Figure 1:
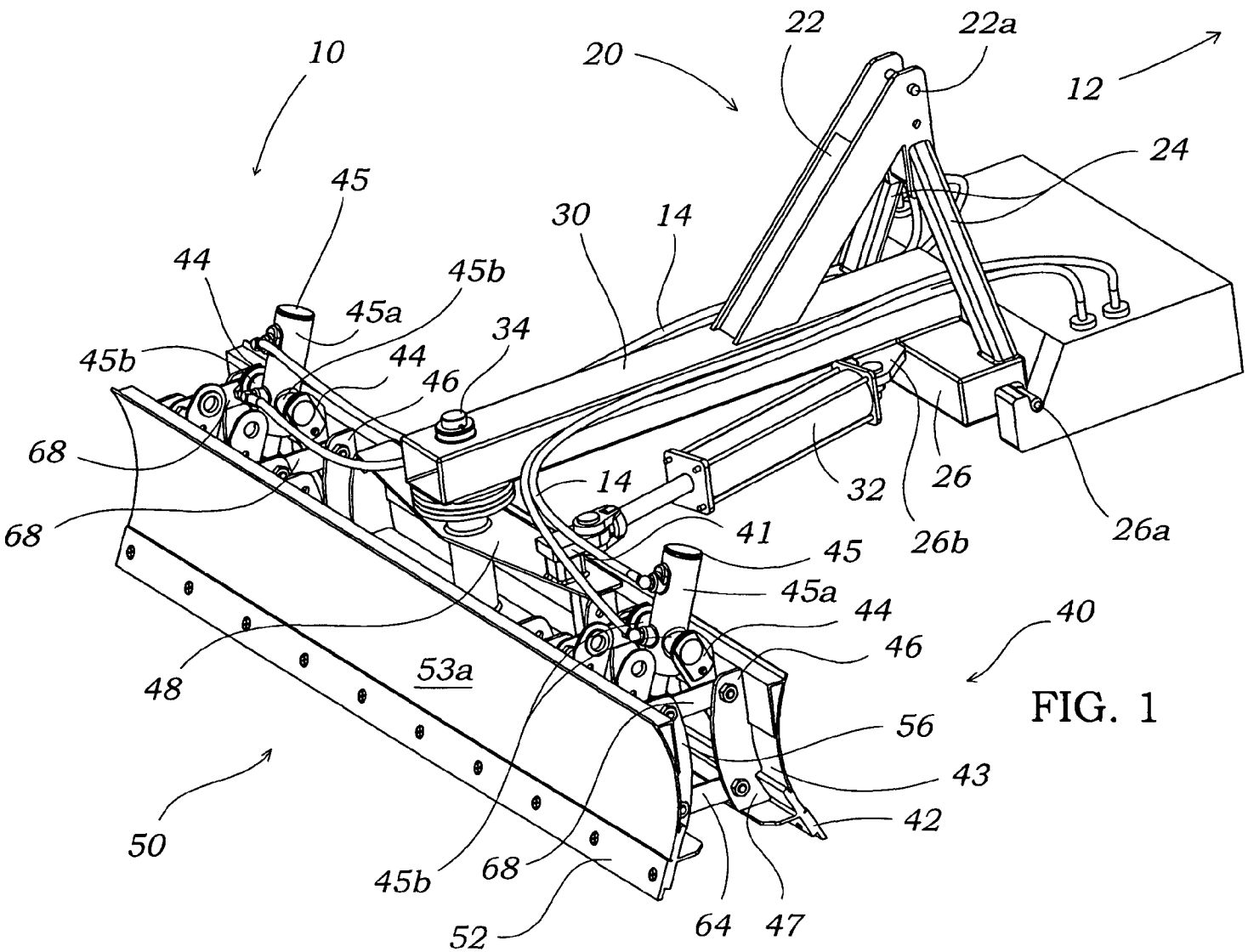
FIG. 1 provides a perspective view of one embodiment of the dual blade unit.

| Element Description | Element Number |
|---|---|
| Dual blade unit | 10 |
| Prime mover | 12 |
| Hydraulic conduit | 14 |
| Nut | 16 |
| Bolt | 18 |
| Hitch member | 20 |
| Top mount | 22 |
| Top pin | 22a |
| Cross brace | 24 |
| Horizontal mount | 26 |
| Horizontal pin | 26a |
| Angle cylinder mount | 26b |
| Extending arm | 30 |
| Angle cylinder | 32 |
| Blade pivot pin | 34 |
| First blade | 40 |
| Angle cylinder connector | 41 |
| First blade edge | 42 |
| First blade non-working face | 43 |
| First blade working face | 43a |
| First blade cylinder connector | 44 |
| Blade cylinder | 45 |
| Blade cylinder body | 45a |
| Blade cylinder pivot | 45b |
| First blade link connector | 46 |
| First blade translator connector | 47 |
| Strengthening member | 48 |
| Second blade | 50 |
| Second blade edge | 52 |
| Second blade non-working face | 53 |
| Second blade working face | 53a |
| Second blade link connector | 56 |
| Second blade translator connector | 57 |
| Translator | 60 |
| Central portion | 62 |
| Outer portion | 64 |
| Translator cylinder connector | 66 |
| Blade link | 68 |

Before the various embodiments of the present invention are explained in detail, it is to be understood that the invention is not limited in its application to the details of construction and the arrangements of components set forth in the following description or illustrated in the drawings. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

DETAILED DESCRIPTION

Referring now to the drawings, wherein like reference numerals designate identical or corresponding parts throughout the several views, FIG. 1 provides a perspective view of the dual blade unit 10, which may be mounted to a prime mover 12. In this embodiment, the dual blade unit 10 utilizes a hitch member 20 that is adapted to fit existing three-point hitches, which are well known to those skilled in the art and therefore will not be explained in detail herein. In other embodiments not pictured herein, the hitch member 20 is comprised of a two-point hitch. In still other embodiments not pictured herein, the hitch member 20 is configured so that the dual blade unit 10 may be affixed to the rear portion of a small truck. Accordingly, the hitch member 20 may be configured in an infinite number of ways, and any hitch member 20 that connects a prime mover 12 to the dual blade unit 10 may be used therewith out departing from the scope of the dual blade unit 10.

The hitch member 20 shown in the embodiments pictured herein includes a horizontal mount 26, which is connected to an extending arm 30 in such a manner so that the extending arm 30 and horizontal mount are substantially perpendicular. A horizontal pin 26*a* is positioned at either end of the horizontal mount 26 to pivotally engage the prime mover 12. An angle cylinder mount 26*b* also may be affixed to the horizontal mount 26. Also affixed to either end of the horizontal mount 26 are two cross braces 24, which are angled toward one another and affixed to a top mount 22 directly above the extending arm 30. One end of the top mount 22 is affixed to the extending arm 30 and the opposite end is affixed to both cross braces 24. The embodiment of the dual blade unit 10 pictured herein includes a top pin 22*a* in the top mount 22 to pivotally engage the prime mover 12. In embodiments of the dual blade unit 10 using attachment structures different than the hitch member 20 pictured herein, a top pin 22*a* and/or horizontal pins 26*a* may or may not be used. The cross braces 24 provides structural support to the hitch member 20 such that the top mount 22, cross braces 24, and horizontal mount form a triangle. In other embodiments not pictured herein the hitch member 20 does not include cross braces 24. In still other embodiments not pictured herein the cross member 20 includes more cross braces 24 than shown in the embodiments pictured herein.

The embodiments of the dual blade unit 10 as pictured herein are primarily adapted for mounting on the rear portion of a prime mover 12. However, in other embodiments not pictured herein, the dual blade unit 10 may be mounted to the front of a prime mover 12. For example, it is contemplated that in certain applications it will be advantageous to mount the dual blade unit 10 to the front of a skid steer (not shown) type of prime mover 12. The required structure and/or mounting methods are well known to those skilled in the art and will therefore not be described in detail herein.

The second end of the extending arm 30, which end is oriented furthest from the hitch member 20, is pivotally engaged with the blade pivot pin 34. The blade pivot pin 34 is fixedly attached to the top side of the first blade 40, and the first blade 40 is pivotally engaged with a second blade 50, which engagement is described in detail below. At least one strengthening member 48 may be fashioned in the first blade 40 around the blade pivot pin 34 so that the dual blade unit 10 is able to withstand more rigorous use and/or applications. In the embodiment pictured herein, the extending arm 30 and hitch member 20 travel in a direction parallel to the direction of travel of the prime mover 12. However, the angle of the first and second blades 40, 50 with respect to extending arm 30 is adjustable in the embodiments of the dual blade unit 10 pictured herein.

An angle cylinder 32 may be used to adjust the angle of the first and second blades 40, 50 with respect to the extending arm 30, and consequently with respect to the direction of travel of the prime mover 12. A first end of the angle cylinder 32 is pivotally attached to the angle cylinder mount 26*b* fashioned in the horizontal mount 26 of the hitch member 20. The second end of the angle cylinder 32 is pivotally attached to an angle cylinder connector 41 fashioned toward the front of the first blade 40. As the angle cylinder 32 is retracted, the right side of the first and second blades 40, 50 (i.e., the side closest to the viewer from the vantage shown in FIG. 1) is drawn towards the prime mover 12 and first blade 40 (and consequently the second blade 50) pivots with respect to the extending arm 30 about the blade pivot pin 34. Accordingly, the left side of the first and second blades 40, 50 is pushed away from the prime mover 12. As the angle cylinder 32 is extended, the opposite action occurs—the right side of the first and second blades 40, 50 moves away from the prime mover 12 and the left side moves toward the prime mover 12.

As is well known to those skilled in the art, hydraulic conduit 14 may be used to convey pressurized fluid from a source of pressurized hydraulic fluid (not shown explicitly, but often a feature of the prime mover 12) to the angle cylinder 32, thereby providing the necessary motive force to actuate the angle cylinder 32, as well as the blade cylinder(s) 45, which is described in detail below. Furthermore, either the angle cylinder 32 or the blade cylinder 45 may be powered by a motive force other than pressurized liquid. For example, the angle cylinder 32 and/or blade cylinder 45 may be pneumatic, electric, or powered by any other suitable motive force known to those skilled in the art, including any suitable fluid. In still other embodiments, the angle cylinder 32 and/or blade cylinder 45 are manually adjusted. In such an embodiment, the angle cylinder 32 and/or blade cylinder 45 may be comprises of a screw jack (not shown). Accordingly, any method and/or structure known to those skilled in the art that is operable to expand and contract in a linear fashion may be used with the dual blade unit 10 without departing from the spirit and scope of the present disclosure.

The working portion of the dual blade unit 10 is comprised of two different blades, a first blade 40 and a second blade 50. The first blade 40 has a first blade working face 43*a* and a first blade non-working face 43, and the second blade 50 has a second blade working face 43 and a second blade non-working face 53. The working blade faces 43*a*, 53*a* are positioned on the side of the blade 40, 50 that is oriented to engage the material to be moved or surface to be engaged when the blade 40, 50 is in the working position (i.e., the lowered position). Alternatively, the non-working blade faces 43, 53 are oriented as the trailing face of the blade 40, 50 that does not contact the material to be moved or surface to be engaged when that blade 40, 50 is in the working position.

Figure 2:
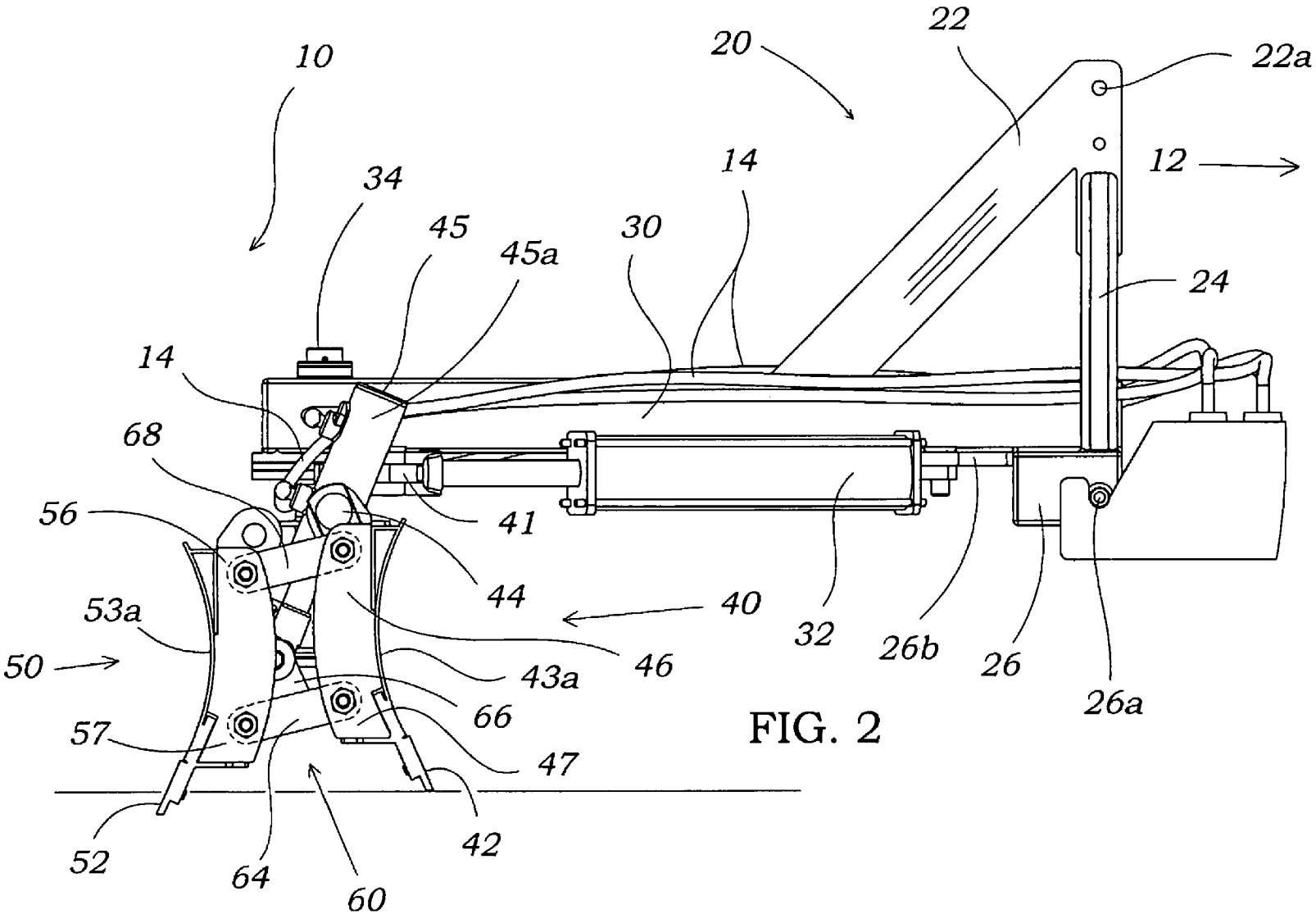
FIG. 2 provides a right side view of one embodiment of the dual blade unit with the second blade in the working position.
Figure 3:
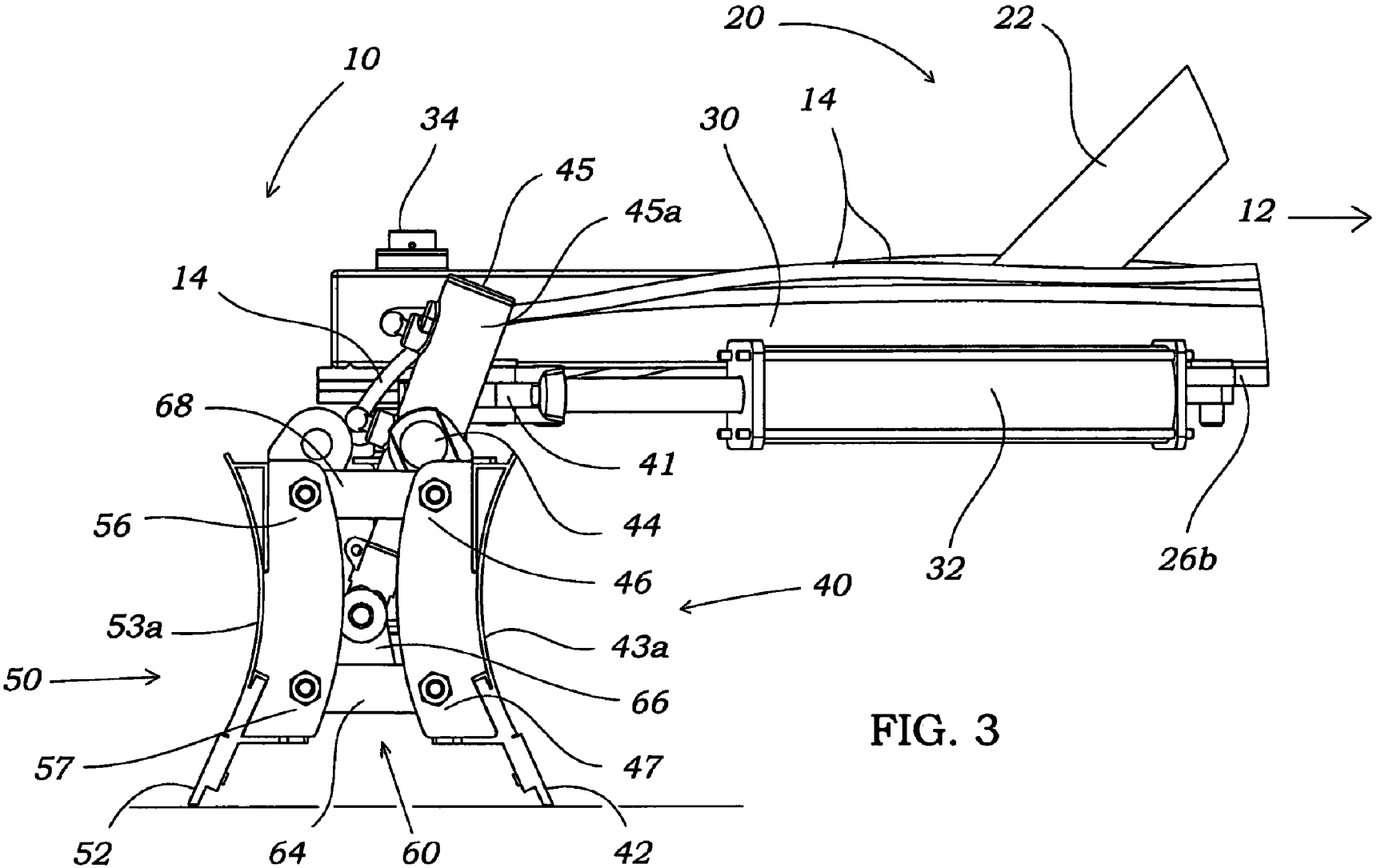
FIG. 3 provides a right side view of one embodiment of the dual blade unit with the first and second blades in the working position.
Figure 4:
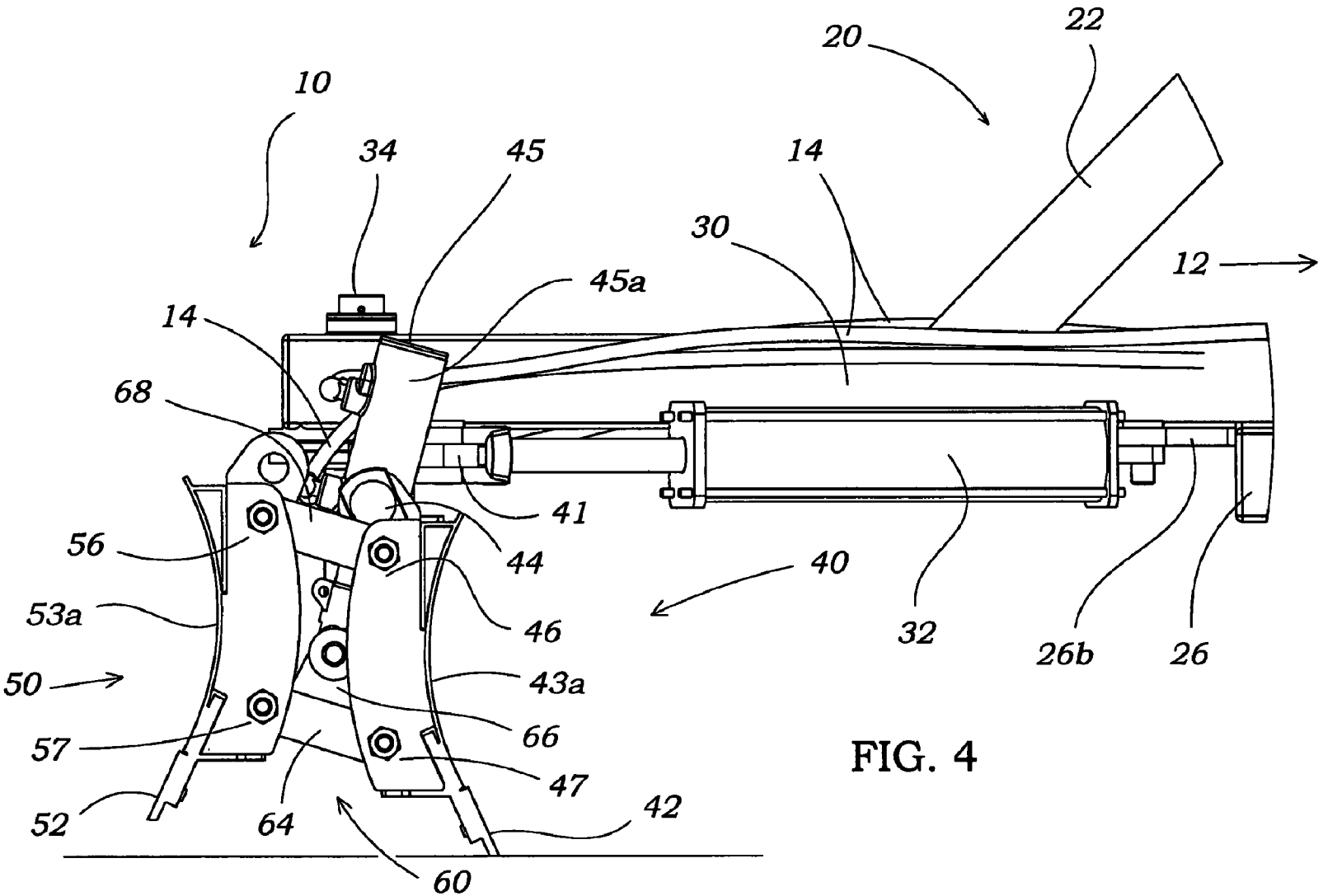
FIG. 4 provides a right side view of one embodiment of the dual blade unit with the first blade in the working position.

At the bottom of the first blade 40 a first blade edge 42 to be positioned toward the first blade working face 43*a*, and a second blade edge 52 may be similarly positioned on the second blade 50. The blade edges 42, 52 will typically perform the majority of engagement with the material to be moved or surface to be engaged. As is well known to those skilled in the art, blades 40, 50 of the type shown herein are typically operated so that the blade 40, 50 is moved in such a way so that in the working position, the working blade face 43*a*, 53*a* is the leading face of the blade 40, 50. That is, as shown in FIG. 2, the second blade 50 is in the working position, and as shown in FIG. 4 the first blade 40 is in the working position. Other types of blades 40, 50 or blade edges 42, 52 may be used with the dual blade unit 10 without departing from the scope of thereof, and the particular embodiments shown herein are meant for exemplary purposes only and in no way limit the scope of the present disclosure.

Figure 8:
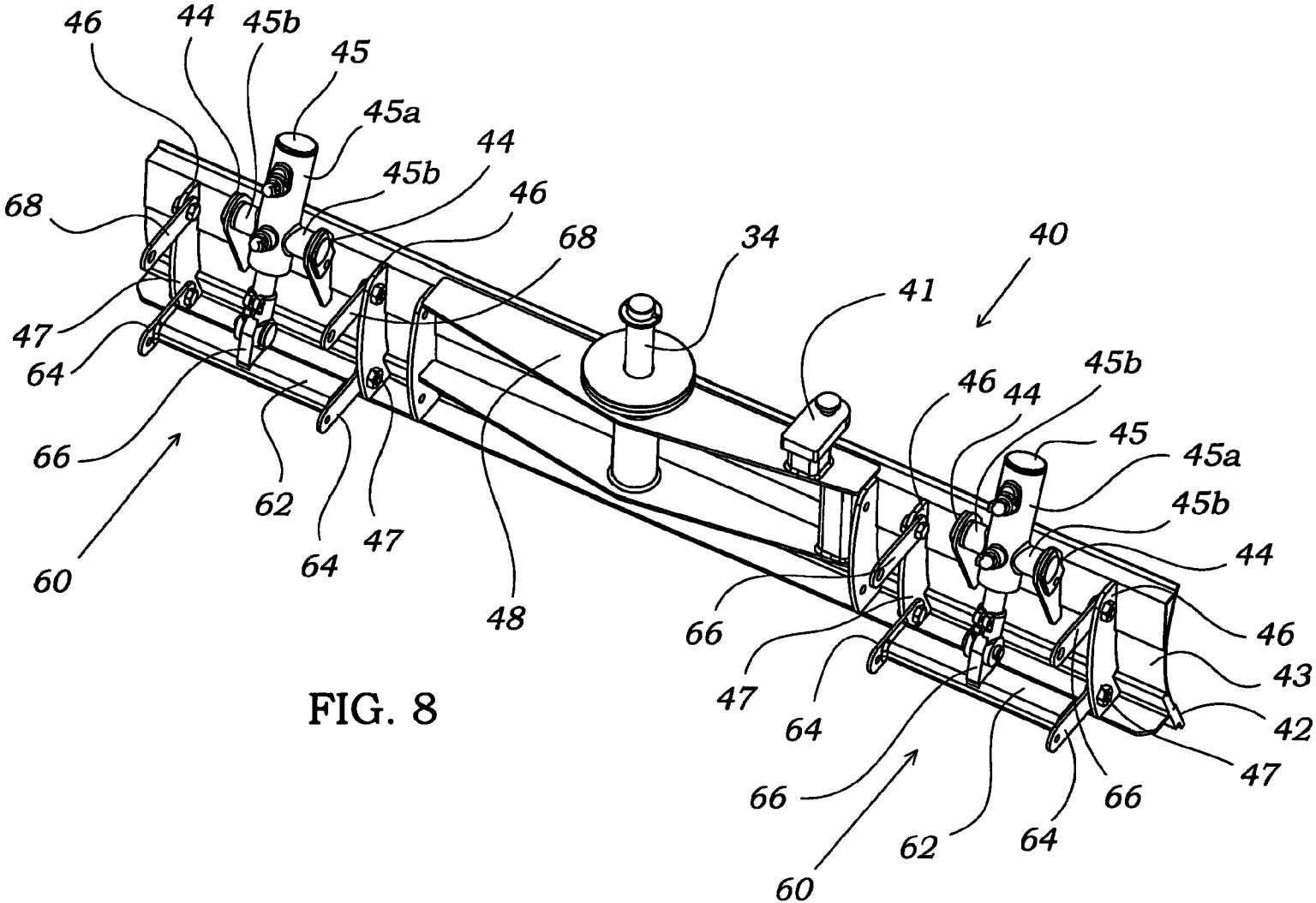
FIG. 8 provides perspective view of the one embodiment of the dual blade unit with the second blade removed for clarity.

The two blades 40, 50 may be pivotally connected to one another through several different members. In the embodiments pictured herein, the blades 40, 50 are pivotally connected through four blade links 68, and two translators 60 coupled to two blade cylinders 45, which are best shown in FIG. 8, which shows one embodiment of the dual blade unit 10 with the second blade 50 removed for clarity. Two blade links 68 may be positioned above each translator 60 on either side thereof.

Figure 5:
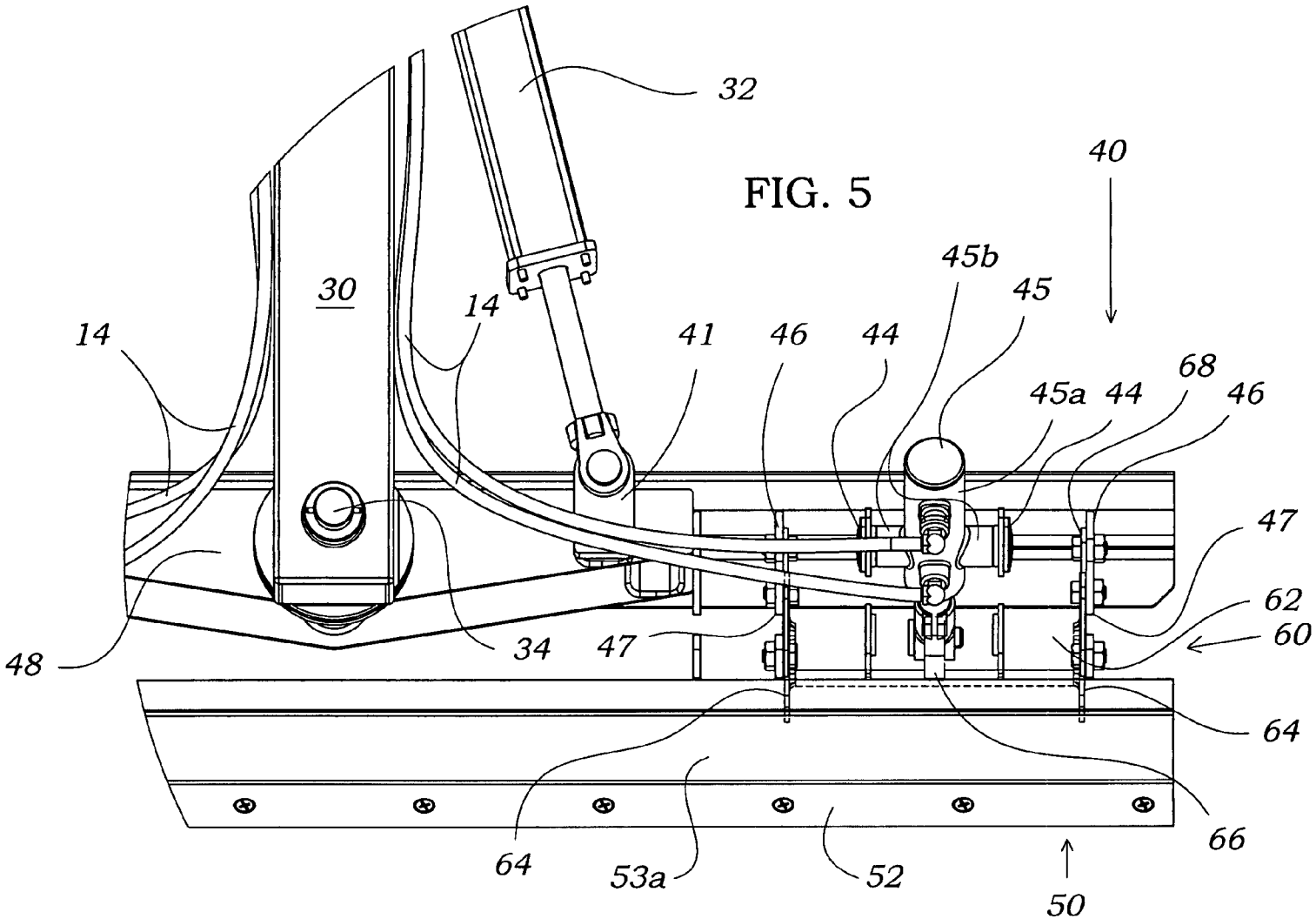
FIG. 5 provides an elevated view of the right side of one embodiment of the dual blade unit.

An elevated perspective view of the right side of one embodiment of the dual blade unit 10 is shown in FIG. 5. As best shown in FIG. 5, each blade 40, 50 may be formed with one first blade link connector 46 and one second blade link connector 56, respectively, for each blade link 68 positioned between the two blades 40, 50. On the embodiment pictured herein, the link connectors 46, 56 are formed on the non-working faces 43, 53. That is, for each blade link 68, the first blade 40 will have one first blade link connector 46 formed on the first blade non-working face 43 and the second blade 50 will have one second blade link connector 56 formed on the second blade non-working face 53.

Figure 6:
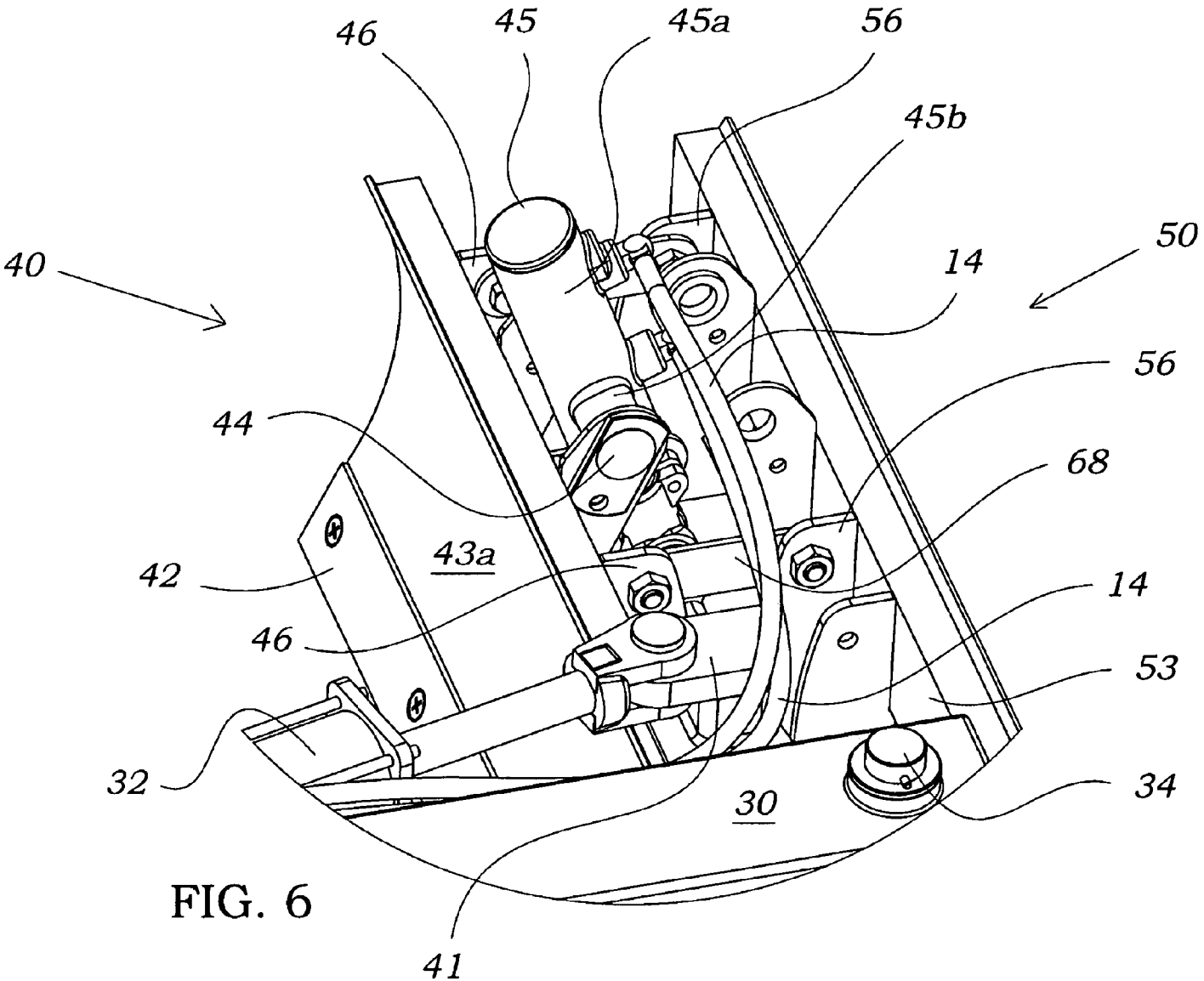
FIG. 6 provides an elevated perspective view of the right side of one embodiment of the dual blade unit.
Figure 7:
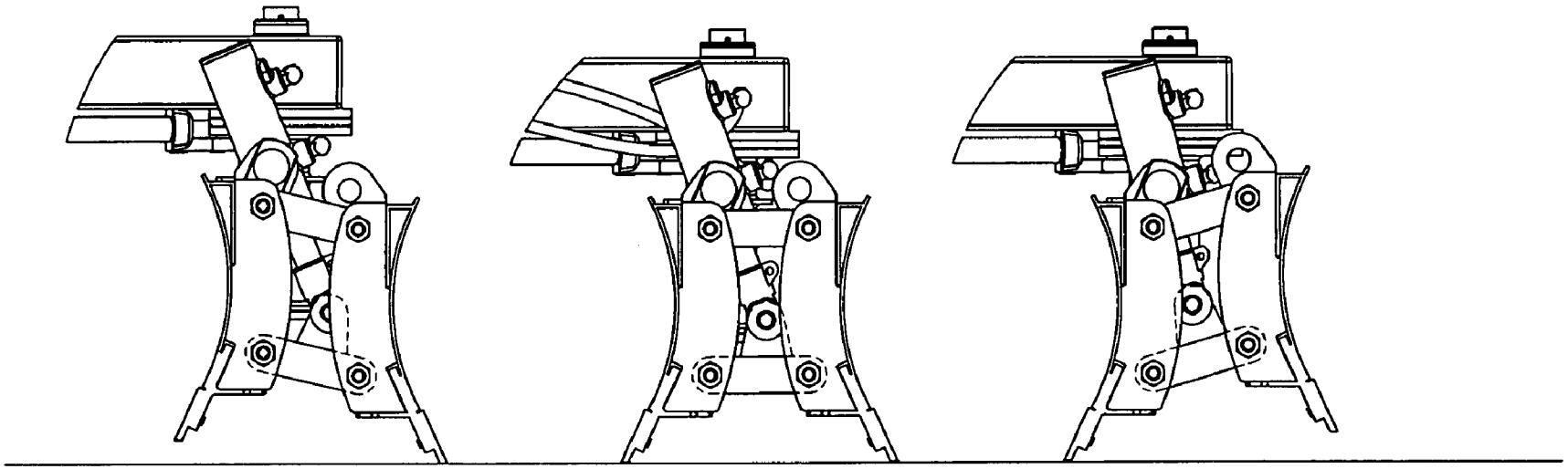
FIG. 7 provides a side view of one embodiment of the dual blade unit showing the progression from left to right of the second blade in the working position, the first and second blades even, and the first blade in the working position.

In the embodiments pictured herein, the blade links 68 are connected to the link connectors 46, 56 via corresponding nuts 16 and bolts 18, but any connection structure and/or method that allows the blade link 68 to pivot with respect to the link connector 46, 56, which connection structure and/or method is known to those skilled in the art may be used without departing from the scope of the present disclosure. The embodiment pictured herein employs a total of four blade links 68; two on the right side (as may be seen in FIGS. 5 and 6) and two on the left side in locations symmetrical with respect to the extending arm 30 to those on the right side, all of which blade links 68 are shown in FIG. 8. Other numbers of blade links 68 and link connectors 46, 56 may be used depending on the particular application of the dual blade unit 10, and the specific number of blade links 68 and/or link connectors 46, 56 in no way limits the scope of the present disclosure.

As best shown in FIGS. 2-4 and 8, at least one translator 60 also may be used to pivotally connect the two blades 40, 50 to one another. When viewed from above (FIG. 5), the translator 60 is generally an I-shaped member, wherein the central portion 62 forms the backbone of the "I" and an outer portion 64 forms either horizontal end portion of the "I" shape. One translator 60 is shown from the side in FIGS. 2-4, wherein one outer portion 64 of the translator 60 is shown. From the views provided in FIGS. 2-4 the translator 60 appears similar to a blade link 60 as the outer portions 64 have a similar design to that of the blade links 68.

As previously mentioned, the translators 60 are positioned below the blade links 60 in the embodiment pictured herein. However, in other embodiments not pictured herein, the translator 60 may be positioned above the blade links 68, or the translator 60 may have blade links 68 positioned above and below the translator 60. Whereas the blade links 68 in the embodiments pictured herein are primarily a flat, rectangular-shaped member, the translator 60 is more complicated in structure. As best shown in FIGS. 5 and 8, the translator 60 in the embodiments pictured herein includes a central portion 62 that is positioned between and affixed to two outer potions 64, which are similar in structure to the blade links 68. The two outer portions 64 are formed with first and second ends similar to the first and second ends of the blade links 68.

The outer portions 64 of the translator 60 pivotally connect to translator connectors 47, 57 formed on the non-working faces 43, 53 of the blades 40, 50 in the same manner as the blade links 68 pivotally connect to the link connectors 46, 56 as described above. Again, nuts 16 and corresponding bolts 18 may be used to connect the outer portions 64 to the translator connectors 47, 57, but other methods and/or structures known to those skilled in the art may also be used without departing from the scope of the present disclosure.

In the embodiments pictured herein, several first blade cylinder connectors 44 are formed in the first blade non-working face 43, which is best shown in FIG. 8. A blade cylinder 45, which in the embodiments pictured herein includes a blade cylinder body 45*a* and two blade cylinder pivots 45*b* formed on either side of the blade cylinder body 45*a*, may be mounted to a pair of first blade cylinder connectors 44. To pivotally connect the blade cylinder 45 to the first blade 40, the blade cylinder pivots 45*b* are pivotally engaged with the first blade cylinder connectors 44. The structure employed to accomplish the pivotal engagement between the blade cylinder 45 and first blade will vary depending on the embodiment of the dual blade unit 10. For example, the engagement may be accomplished through a rod and sleeve design as shown, or through an arm mounted on the blade cylinder body 45*a* pivotally engaged with the first blade 40. Accordingly, any structure and/or method known to those skilled in the art may be used to pivotally engage each blade cylinder 45 with the first blade 40 without departing from the spirit and scope of the present disclosure. Each blade cylinder 45 is supported by a pair of first blade cylinder connectors 44, as is readily apparent to those skilled in the art in light of the present disclosure.

The central portion 62 of the translator 60 in the embodiment of the dual blade unit 10 pictured herein includes a translator cylinder connector 66, to which the second end of a blade cylinder 45 is pivotally connected. A pin (not called out in the various figures) and key (not shown) may be used to pivotally connected the second end of the blade cylinder 45 to the translator cylinder connector 66, but other methods and/or structures known to those skilled in the art may be used to pivotally connect those elements without departing from the scope of the present disclosure. In the embodiment pictured herein, two blade cylinders 45 are employed—one for each translator 60—and are configured in a master-slave arrangement, which arrangement is well known to those skilled in the art and therefore will not be explained in detail herein. However, the number of blade cylinders 45 used for the specific embodiment of the dual blade unit 10 will vary depending on the application for the dual blade unit 10 in the same manner as the number of blade links 68 and translators 60 will vary, and is therefore in no way limiting.

The blade cylinders 45 provide the motive force for adjusting the height of the blades 40, 50 with respect to one another. The vertical position of the blade cylinder body 45*a* of the blade cylinder 45 is fixed with respect to the vertical position of the first blade 40. However, the vertical positions of the blade links 68, translators 60, and second blade 50 are dynamic with respect to one another and with respect to the vertical position of the blade cylinder 45 and the first blade 40. Furthermore, the vertical angle of the blade cylinder 45 with respect to the first blade 40 may change as the blade cylinder 45 is actuated.

As the blade cylinder 45 is extended, the blade cylinder body 45*a* may pivot about the first blade cylinder connectors 44, and consequently the translator cylinder connector 66 lowered with respect to the first blade 40, which lowers the second blade 50 with respect to the first blade 40. The second blade 50 may be lowered to a position similar to that shown in FIG. 2, wherein the second blade 50 is in the working position, or the second blade 50 may be positioned at any position between FIGS. 2 and 4, such as the position shown in FIG. 3. As the blade cylinder 45 is retracted, the blade cylinder body 45*a* may pivot about the first blade cylinder connectors 44 in a direction opposite to that when the blade cylinder 45 is extended, which causes the second blade 50 to rise with respect to the first blade 40 to the position shown in FIG. 3, and eventually to the position shown in FIG. 4, wherein the first blade 40 is in the working position. As with the angle cylinder 32, hydraulic conduit 14 may be used to transport pressurized fluid to provide the motive power for extending and retracting the blade cylinder(s) 45. The maximum vertical difference between the first blade 40 and second blade 50 allowed by the dual blade unit 10 will vary from one embodiment thereof to the next, and may be as little as two inches but as great as thirty-six inches.

The different angles of the blade links 68 and outer portions 64 of the translator 60 when the dual blade unit 10 is in different positions are best seen by comparing FIGS. 2, 3, 4, and 7. From a comparison of these figures, it will be apparent to those skilled in the art that the vertical position of the first blade 40 with respect to the extending arm 30 is constant, and only the vertical position of the second blade 50 varies with respect to the extending arm 30. However, the vertical position of dual blade unit 10, including the extending arm 30, may be adjusted through manipulation of the hitch member 20, depending on the specific embodiment thereof. In the embodiment pictured herein, the three-point hitch on the prime mover 12 may be used to raise and lower the hitch member 20 with respect to the surface on which the prime mover 12 is positioned, which in turn raises and lowers the extending arm 30 and dual blade unit 10. Furthermore, from FIGS. 2, 3, and 4 it is clear that the blade links 68 and the outer portions 64 of the translator 60 remain substantially parallel to one another throughout the three positions. This relation may also be seen in FIG. 7, which shows three separate, scaled side views of the dual blade unit 10 analogous to FIGS. 2, 3, and 4.

In an alternative embodiment not pictured herein, the dual blade unit 10 does not include any blade cylinders 45. In such an embodiment, the height the first blade 40 with respect to the second blade 50 may be controlled through a manual locking assembly and lever machinery (not shown). For example, the lever machinery could be attached to the translator 60 and first blade 40 in the same manner as the blade cylinder 45 is connected to those elements, wherein a lever could extend above the dual blade unit 10 to provide the operator with leverage when adjusting the elevation relation between the blades 40, 50. A moveable locking pin and notched structure (not shown) may be used to secure the angle of the lever. Accordingly, the lever would work in a manner similar to that of the blade cylinder 45, although the lever would be of fixed length.

In another embodiment not pictured herein, the blade links 68 and translators 60 may be replaced with a sliding mechanism. The sliding mechanism would allow the second blade 50 to move vertically with respect to the first blade 40 and could also be used with a blade cylinder 45 for adjusting the height, or the lever mechanism explained above. Accordingly, and method and/or structure known to those skilled in the art that allows the vertical position of the second blade 50 with respect to that of the first blade 40 to be adjusted while simultaneously assuring that the horizontal position of the second blade 50 with respect to the first blade 40 is constant may be used with the dual blade unit 10 without departing from the spirit and scope of the present disclosure.

Those skilled in the art will appreciate that the various elements of the dual blade unit 10, including the extending arm 30 and hitch member 20, may be fashioned differently than in the embodiments pictured and described herein without departing from the spirit and scope of the present disclosure. The shapes, orientations, and relative dimensions of the various elements of the embodiment pictured herein are for illustrative purposes only, and by no means limit the scope of the present disclosure.

In the embodiments pictured herein, the translator connectors 47, 57 link connectors 46, 56, and first blade cylinder connectors 44, are formed as one continuous piece and integral to the non-working face 43, 53 of the respective blade 40, 50, as best seen for the first blade 40 in FIG. 8. However, in other embodiments the various components integrally formed with either blade 40, 50 may be non-integrally formed with the blade 40, 50, but later affixed to one another by any structure and/or method known to those skilled in the art. Two translators 60 are employed in the embodiment of the dual blade unit 10 pictured herein; one on the right side best shown in FIGS. 5 and 8, and one on the left side best shown in FIG. 8. However, a different number of translators 60 may be used depending on the application for which the dual blade unit 10 is designed, and the specific number of translators 60 in no way limits the scope of the present disclosure.

Furthermore, the translators 60 may be oriented in a manner other than symmetrically about the blade pivot pin 34.

The hitch member 20, extending arm 30, and dual blade unit 10 may be constructed of any suitable material known to those skilled in the art, including iron, steel, aluminum, any other material suitable for the application of the dual blade unit 10, or combinations thereof. Furthermore, the various elements of the dual blade unit 10 may be formed as one continuous member, or they may be formed separately and later affixed together by methods and/or structures appropriate for the materials of construction. For example, the link connectors 46, 56 may be formed with the blades 40, 50 as a single, contiguous structure, or the link connectors 46, 56 may be later affixed to the blades 40, 50 through an appropriate process, such as welding, gluing, or other methods known to those skilled in the art.

It should be noted that the dual blade unit 10 is not limited to the specific embodiments pictured and described herein, but is intended to apply to all similar apparatuses for allowing one implement to serve as a bi-directional earth-working or material-moving apparatus. Accordingly, modifications and alterations from the described embodiments will occur to those skilled in the art without departure from the spirit and scope of the dual blade unit 10.

Furthermore, variations and modifications of the foregoing are within the scope of the dual blade unit 10. It is understood that the dual blade unit 10 as disclosed and defined herein extends to all alternative combinations of two or more of the individual features mentioned or evident from the text and/or drawings. All of these different combinations constitute various alternative aspects of the dual blade unit 10. The embodiments described herein explain the best modes known for practicing the dual blade unit 10 and will enable others skilled in the art to utilize the same. The claims are to be construed to include alternative embodiments to the extent permitted by the prior art.

What is claimed is:

1. A blade unit comprising:

a. a hitch member, wherein said hitch member is configured to be attachable to a prime mover;

b. an extending arm, wherein a first end of said extending arm is operably engaged with said hitch member;

c. a first blade, wherein said first blade is operably engaged with a second end of said extending arm;

d. a second blade, wherein said second blade is substantially parallel to said first blade, wherein said second blade is pivotally affixed to said first blade such that the vertical position of said second blade with respect to said first blade may be adjusted, and wherein the horizontal position of said second blade with respect to said first blade is fixed; and, e. a translator, wherein said-translator is positioned between said first blade and said second blade, wherein a first side of said translator is pivotally affixed to said first blade, and wherein a second side of said translator is pivotally affixed to said second blade.

2. An apparatus for earth working, said apparatus comprising:

a. a hitch member, wherein said hitch member is configured to be attachable to a prime mover;

b. an extending arm, wherein said extending arm has a first and second end, wherein said first end is rigidly affixed to said hitch member;

c. a first blade, said first blade comprising:

i. a blade pivot pin protruding upwardly therefrom, wherein said extending arm second end is pivotally engaged with said blade pivot pin;

ii. at least one link connector fashioned on a non-working face of said first blade;

iii. at least one blade cylinder connector fashioned on said non-working face of said first blade;

iv. at least one translator connector fashioned on said non-working face of said first blade;

d. a second blade, said second blade comprising:

i. at least one link connector fashioned on a non-working face of said second blade;

ii. least one translator connector fashioned on said non-working face of said second blade;

e. at least one blade link having first and second ends, wherein said blade link first end is pivotally attached to said at least one link connector in said first blade, and wherein said blade link second end is pivotally attached to said at least one link connector in said second blade;

f. at least one translator, said at least one translator comprising:

i. at least one outer portion with first and second ends wherein said outer portion first end is pivotally mounted to said at least one translator connector in said first blade, and wherein said outer portion second end is pivotally mounted to said at least one translator connector in said second blade;

ii. a central portion, wherein said at least one outer portion is affixed to said central portion;

iii. a translator cylinder connector, wherein said translator cylinder connector is affixed to said central portion; and g. at least one blade cylinder having first and second ends, wherein said blade cylinder first end is pivotally connected to said at least one blade cylinder connector in said first blade, and wherein said blade cylinder second end is pivotally connected to said translator cylinder connector.

3. The apparatus according to claim 2 wherein said hitch member is further defined as comprising:

a. a top mount, wherein a first end of said top mount is affixed to said extending arm, and wherein a second end of said top mount attaches to a prime mover;

b. a horizontal mount, wherein said horizontal mount is affixed to said extending arm and oriented substantially perpendicular thereto; and c. at least one cross brace, wherein said at least one cross brace is affixed to both said top mount and said horizontal mount.

4. The apparatus according to claim 2 further comprising:

a. an angle cylinder mount affixed to said horizontal mount of said hitch member;

b. an angle cylinder connector affixed to said first blade; and c. an angle cylinder, wherein a first end of said angle cylinder is pivotally engaged with said angle cylinder mount, and wherein a second end of said angle cylinder is pivotally engaged with said angle cylinder connector.

5. The apparatus according to claim 2 further comprising hydraulic conduit, wherein said hydraulic conduit fluidly connects said at least one blade cylinder to a source of pressurized fluid.

6. The apparatus according to claim 2 further defined so that the maximum vertical difference between said first blade and said second blade is eighteen inches.

7. The apparatus according to claim 3 wherein said hitch member is further defined as being adapted for attachment to a conventional three-point hitch.

8. The apparatus according to claim 2 wherein said hitch member is further defined as being adapted for attachment to the front of a prime mover.

9. The apparatus according to claim 2 wherein said at least one blade cylinder is further defined as being powered by a pressurized liquid.

10. The apparatus according to claim 2 wherein said at least one blade cylinder is further defined as being configured as a screw jack.

11. An apparatus for earth working, said apparatus comprising:

a. a hitch member, wherein said hitch member is configured to be attachable to a prime mover;

b. an extending arm, wherein said extending arm has a first and second end, wherein said first end is rigidly affixed to said hitch member;

c. a first blade, said first blade comprising:

i. a blade pivot pin protruding upwardly therefrom, wherein said extending arm second end is pivotally engaged with said blade pivot pin;

ii. four link connectors fashioned on a non-working face of said first blade, wherein said four link connectors are grouped in two pairs, and wherein said blade pivot pin is positioned between said two pairs of link connectors along the length of said first blade;

iii. a first and second blade cylinder connector fashioned on said non-working face of said first blade, wherein said blade pivot pin is positioned between said first and second blade cylinder connectors along the length of said first blade;

iv. four translator connectors fashioned on said non-working face of said first blade, wherein said four translator connectors are grouped in two pairs, and wherein said blade pivot pin is positioned between said two pairs of translator connectors along the length of said first blade;

d. a second blade, said second blade comprising:

i. four link connectors fashioned on a non-working face of said second blade, wherein said four link connectors of said second blade are in an opposed orientation to said four link connectors of said first blade;

ii. four translator connectors fashioned on said non-working face of said first blade, wherein said four translator connectors of said second blade are in an opposed orientation to said four translator connectors of said first blade;

e. four blade links each having second ends, wherein each said blade link is pivotally affixed at either end thereof to a blade link connector of said first blade and the opposing blade link connector of said second blade;

f. a first translator comprising:

i. a central portion;

ii. two outer portions affixed at either end of said central portion, wherein each said outer portion has first and second ends, wherein each said outer portion is pivotally affixed at either end thereof to one translator connector of said first blade and the opposing translator connector of said second blade;

iii. a translator cylinder connector, wherein said translator cylinder connector is affixed to said central portion, and wherein said first translator is positioned on a first side of said blade pivot pin;

g. a second translator comprising:

i. a central portion;

ii. two outer portions affixed at either end of said central portion, wherein each said outer portion has first and second ends, wherein each said outer portion is pivotally affixed at either end thereof to one translator connector of said first blade and the opposing translator connector of said second blade;

iii. a translator cylinder connector, wherein said translator cylinder connector is affixed to said central portion, and wherein said second translator is positioned on a second side of said blade pivot pin; and h. two blade cylinders each having first and second ends, wherein a first blade cylinder is pivotally connected at either end thereof to one blade cylinder connector in said first blade and said translator cylinder connector of said first translator, and wherein a second blade cylinder is pivotally connected at either end thereof to one blade cylinder connector in said first blade and said translator connector of said second translator.

12. The apparatus according to claim 11 wherein said four link connectors, said first and second blade cylinder connectors, and said four translator connectors of said first blade are further defined as being integrally formed with said first blade.

13. The apparatus according to claim 11 wherein said four link connectors and said four translator connectors of said second blade are further defined as being integrally formed with said second blade.

14. The apparatus according to claim 11 wherein said two outer portions of said first and second translators are further defined as being welded to said central portions of said first and second translators, respectively.

15. The apparatus according to claim 11 wherein said two blade cylinders are further defined as being powered by pressurized fluid.

* * * * *